US008756715B1

(12) United States Patent
Moffitt, Jr.

(10) Patent No.: US 8,756,715 B1
(45) Date of Patent: Jun. 24, 2014

(54) SPORT HELMET WITH VENTILATING FAN

(76) Inventor: Henry E. Moffitt, Jr., Corinth, NY (US)

( * ) Notice: Subject to any disclaimer, the term of this patent is extended or adjusted under 35 U.S.C. 154(b) by 1044 days.

(21) Appl. No.: 12/816,044

(22) Filed: Jun. 15, 2010

Related U.S. Application Data

(60) Provisional application No. 61/268,542, filed on Jun. 15, 2009.

(51) Int. Cl.
*A42C 5/04* (2006.01)

(52) U.S. Cl.
USPC ..... 2/171.3

(58) Field of Classification Search
USPC ..... 2/9, 410, 15, 421, 424, 171.3, 6.3, 6.5, 2/8.6
See application file for complete search history.

(56) References Cited

U.S. PATENT DOCUMENTS

| | | | | |
|---|---|---|---|---|
| 1,774,074 | A * | 8/1930 | Wittcoff | 2/171.7 |
| 3,822,698 | A * | 7/1974 | Guy | 128/201.25 |
| 3,881,198 | A | 5/1975 | Waters | |
| 4,309,774 | A | 1/1982 | Guzowski | |
| 4,502,480 | A | 3/1985 | Yamamoto | |
| D297,584 | S | 9/1988 | Lenox et al. | |
| 5,148,550 | A | 9/1992 | Hodgkinson et al. | |
| 6,370,695 | B2 * | 4/2002 | Paris et al. | 2/171.3 |
| 6,513,168 | B2 | 2/2003 | Paris et al. | |
| 6,745,400 | B1 | 6/2004 | Paciorkowski | |
| 7,010,813 | B2 | 3/2006 | Ahn et al. | |
| 7,200,873 | B2 * | 4/2007 | Klotz et al. | 2/171.3 |
| 7,937,775 | B2 * | 5/2011 | Manzella et al. | 2/171.3 |
| 2007/0113318 | A1 | 5/2007 | Weston | |
| 2007/0113324 | A1 | 5/2007 | Chen | |

* cited by examiner

*Primary Examiner* — Tejash Patel
(74) *Attorney, Agent, or Firm* — Robert C. Montgomery; Montgomery Patent & Design

(57) ABSTRACT

A sport helmet with an integral fan apparatus particularly useful on paintball helmets is herein disclosed, comprising a small fan affixed to a visor portion to propel outside ambient temperature air into helmet and past the face shield. The propelled air, being the same temperature and humidity as the outside air, will eliminate possible fogging and condensation on the surface of the face shield. The fan is battery-powered and is controlled by a small switch located on the exterior of the helmet where it is easily operated by a user. The fan apparatus can also be provided as a retrofit kit for installation onto an existing helmet.

13 Claims, 6 Drawing Sheets

SPORT HELMET WITH VENTILATING FAN

RELATED APPLICATIONS

The present invention was first described in and claims the benefit of U.S. Provisional Application No. 61/268,542 filed Jun. 15, 2009, the entire disclosures of which are incorporated herein by reference.

FIELD OF THE INVENTION

The present invention relates generally to protective headwear used in sports and the like, and in particular, to such protective headwear with additional provisions for providing electric cooling and defogging function.

BACKGROUND OF THE INVENTION

Many popular sports activities are regularly accompanied the use of protective clothing and accessories. In particular, many sports with a high degree of possible contact from either other participants or accessories of the game require that those engaging in the activities be properly protected.

In particular, in such activities, the head is one of the most vulnerable areas of the human body. As a result, helmets are one (1) of the most common protective devices. Such helmets are utilized in activities ranging from football to motor sports to paintball. Common issues with such headgear include problems such physical discomfort, uncomfortable temperatures due to lack of ventilation, and limited visibility. Visibility is often further aggravated by the fact that many helmets utilized for purposes such as motor sports and paintball require the use of transparent or translucent face guards for the purposes of shielding the user's eyes from debris and the like. These faceguards often tend to become foggy due to condensation from the stuffy temperature conditions interior to the helmet.

Various attempts have been made to provide ventilated helmets. Examples of these attempts can be seen by reference to several U.S. patents. U.S. Pat. No. 3,881,198, issued in the name of Waters, describes a detachable air conditioning unit with a corresponding helmet device which provides threadably attachable air cooling and fan capabilities to the helmet.

U.S. Pat. No. 5,148,550, issued in the name of Hodgkinson et al., describes a protective head gear unit which includes filter vents in addition to a removable lens portion.

U.S. Pat. No. 7,010,813, issued in the name of Ahn et al., describes a leisure sports helmet with an integral fan and vents to provide convective heat removal for purposes of cooling a user's head.

Additionally, ornamental designs for headgear with a built-in fan exist, particularly U.S. Pat. No. D 297,584. However, none of these designs are similar to the present invention.

While these devices fulfill their respective, particular objectives, each of these references suffer from one (1) or more of the aforementioned disadvantages. Many such devices are not suitable for use with a variety of conventional sporting headgear styles, particularly existing helmets. Also, many such devices do not provide features of detachability when such ventilating or cooling features are not necessary. In addition, many such devices are not configured in a manner which mitigates condensation on a faceguard portion of the headgear. Accordingly, there exists a need for a sport helmet without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide cooling and convection features to a sports helmet in a manner which significantly mitigates condensation on a faceguard and which is attachable and removable at a user's discretion. Thus, the object of the present invention is to solve the aforementioned disadvantages and provide for this need.

To achieve the above objectives, it is an object of the present invention to comprise features of a conventional sporting helmet such as a paintball helmet which completely encompasses the head and face of a user to provide protection against impact of paintballs and the like. The apparatus comprises a unitary molded "U"-shaped form further comprising a helmet shell, a face shield, and rearwardly extending top vent panels.

Another object of the present invention is to provide a removable visor assembly for protecting the face portion of the user.

Yet still another object of the present invention is to eliminate condensation and fogging of a face shield portion of the helmet. The visor assembly comprises an internal fan powered by an integral battery.

Yet still another object of the present invention is to provide cooling for a user's head via convective ventilation of the interior portion of the helmet through the vent panels.

Yet still another object of the present invention is to provide secure engagement with a user's head via an adjustable head strap assembly which wraps around a user's head in a conventional manner.

Yet still another object of the present invention is to provide enclosure for the fan assembly and shading to a user's face via the removably attachable visor assembly.

Yet still another object of the present invention is to provide anti-fogging functions via secure enclosure and suitable positioning of the fan assembly within an interior space of the visor assembly. The helmet assembly comprises an electrical enclosure, a fan, a battery and associated electrical wiring portions.

Yet still another object of the present invention is to defog the visor assembly by positioning the fan in a manner such that cooled air is sufficiently provided to the visor prior to exiting the helmet via the vent panels. The air flow is directed through a screen cover and ventilation apertures and subsequently a motioned across the face shield portion.

Yet still another object of the present invention is to provide a simple detachment means for connecting and disconnecting the anti-fogging components from the helmet assembly. The detachment means comprises corresponding male and female connectors between the temple portions of the visor assembly and side surfaces of the helmet shell. The electrical connectors are further removably attached to an inner surface of the helmet assembly with a plurality of common clip fasteners.

Yet still another object of the present invention is to provide a user with means to selectively actuate the anti-fogging features of the apparatus via a conventional ON/OFF switch located along a side surface of the helmet shell.

Yet still another object of the present invention is to allow for use of the electrical enclosure, fan, switch, and electrical wiring in a retrofit manner for use with an existing helmet.

Yet still another object of the present invention is to provide a method of utilizing the device that provides a unique means of procuring an apparatus in a desired size and aesthetic appearance, easily installing or replacing the battery powering means, attaching the electrical enclosure to the visor assembly via the fastening means, connecting the visor assembly to the helmet assembly via corresponding fasteners, donning the helmet, selectively securing the helmet via the adjustable strap assembly, activating the fan as desired via the switch to provide cooling and defogging functions, simply deactivating the fan as desired, and easily detaching and removing the fan and electrical components as desired.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
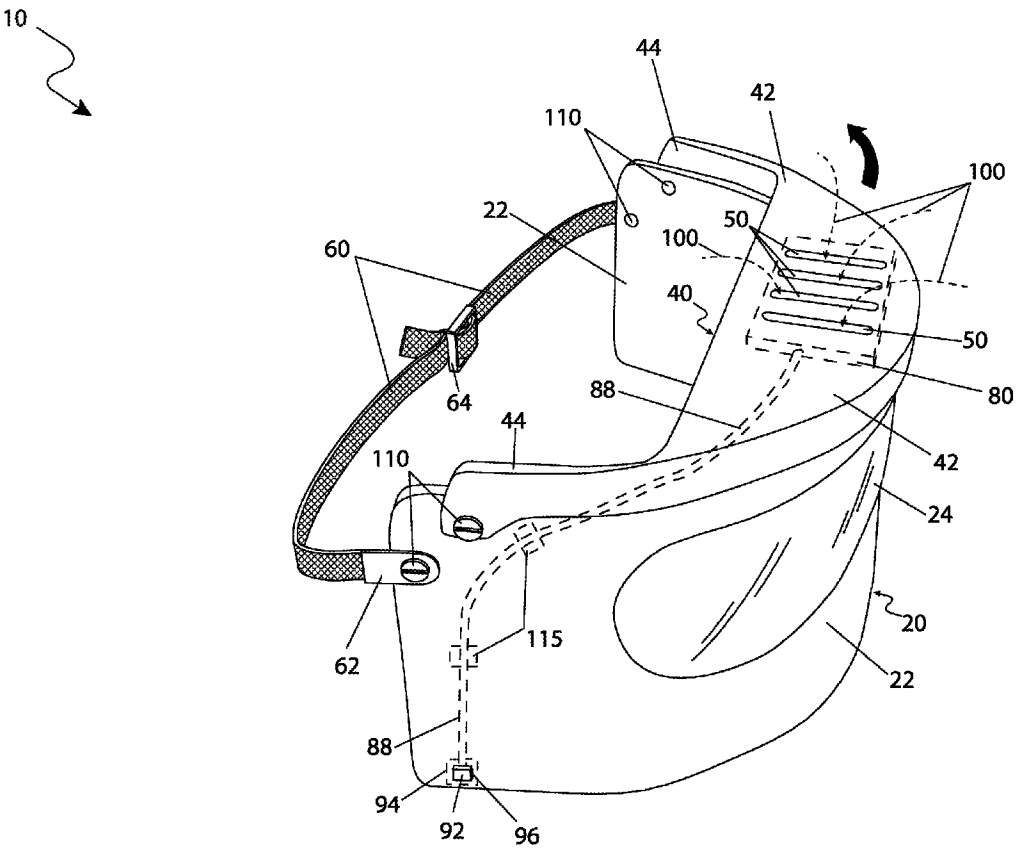
FIG. 1 is a side perspective view of a sport helmet with ventilating fan 10, according to a preferred embodiment of the present invention.

10 sport helmet with ventilating fan
20 helmet assembly
22 helmet shell
24 face shield
25 vent panel
26 ventilation aperture
28 first attachment aperture
30 second attachment aperture
40 visor assembly
42 visor brim portion
44 visor temple portion
46 visor aperture
48 pad
50 intake aperture
60 head strap assembly
62 head strap eyelet
64 length adjusting fitting
80 electrical enclosure
82 fan
84 battery
86 enclosure fastening means
87 screen cover
88 electrical wiring
90 male connector
91 female connector
92 switch
94 switch fastener
96 switch aperture
100 air flow
110 post fastener
111 post
112 screw
115 clip fastener
116 base
118 hook
120 adhesive layer
122 paper backing
150 alternate retrofit embodiment
160 existing helmet
162 existing visor
164 existing face shield
180 existing head strap
185 existing strap fastener

DETAILED DESCRIPTION OF THE PREFERRED EMBODIMENT

Figure 4:
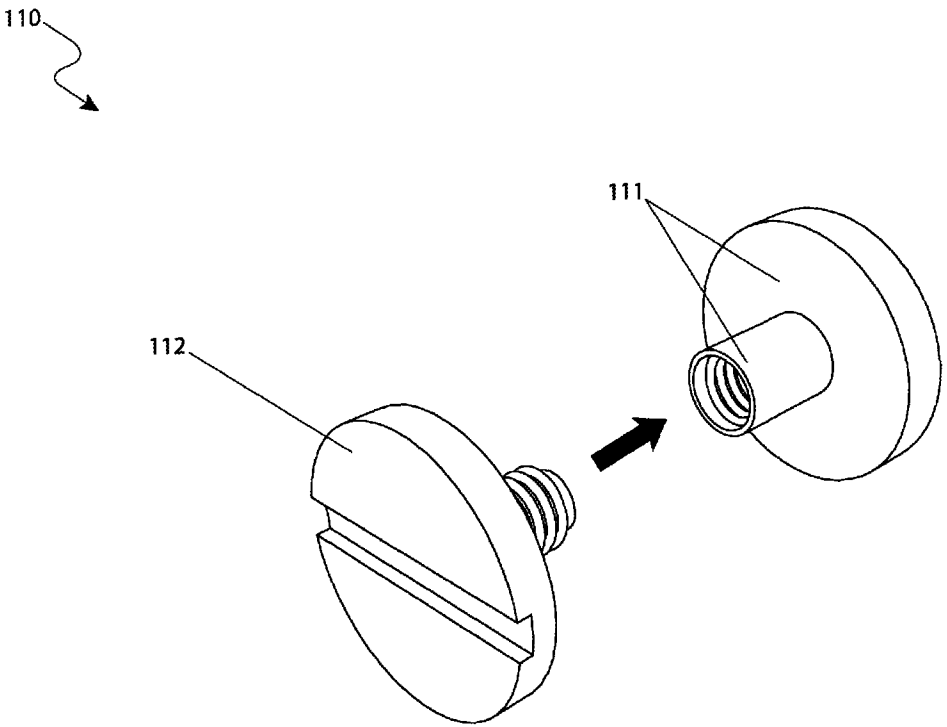
FIG. 4 is a close-up view of a post fastener portion 110 of the of the sport helmet with ventilating fan 10, according to a preferred embodiment of the present invention.
Figure 5:
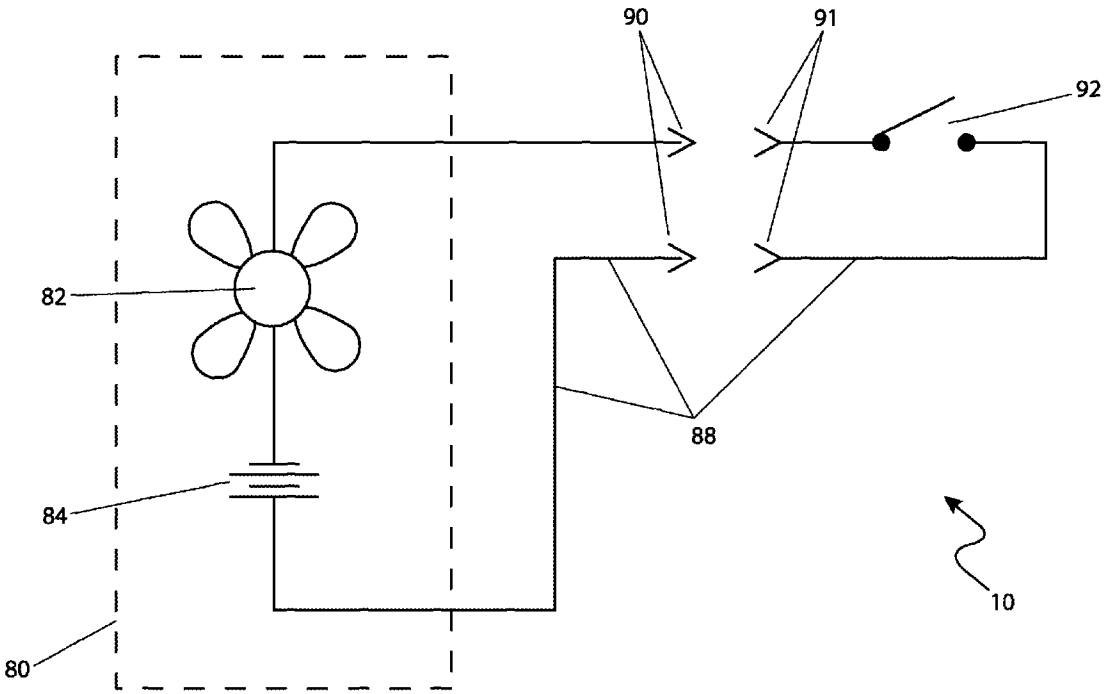
FIG. 5 is an electrical block diagram of the sport helmet with attachable fan 10, according to a preferred embodiment of the present invention; and, FIG. 6 is a side perspective view of an alternate retrofit embodiment 150 of the sport helmet with ventilating fan 10, according to an alternate embodiment of the present invention.
Figure 6:
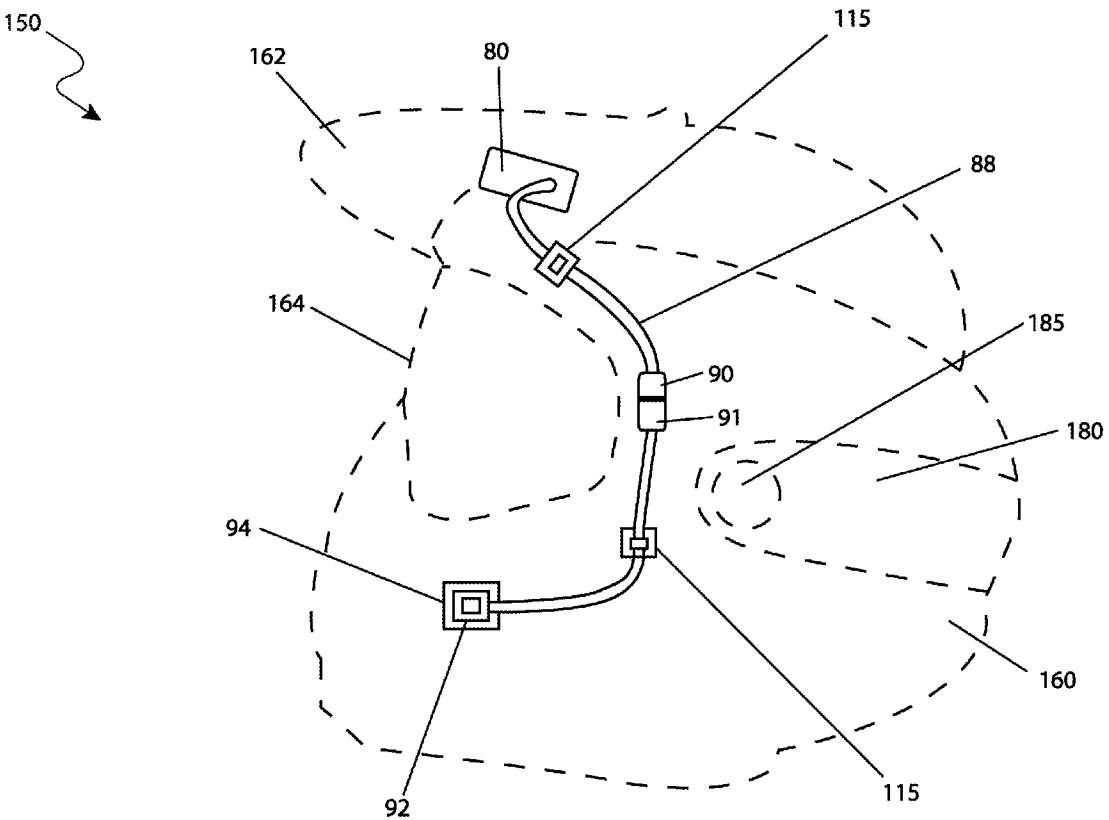

The best mode for carrying out the invention is presented in terms of its preferred embodiment, herein depicted within FIGS. 1 through 5 and in terms of an alternate embodiment, herein depicted within FIG. 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a sport helmet with ventilating fan (herein described as the "apparatus") 10, which provides a sport helmet assembly 20 comprising a removable visor assembly 40 having an internal fan 82 being powered by at least one (1) battery 84. A flow of air 100 produced by the fan 82 eliminates condensation and fogging of a face shield portion 24 while maintaining a normal protection thereto a cranium of a user by the apparatus 10. The apparatus 10 is particularly suited for use during aggressive sport activities such as paintball and the like. The apparatus 10 is to be made using a resilient plastic compound and fabricated in an injection-molding process in various sizes and colors.

Figure 2:
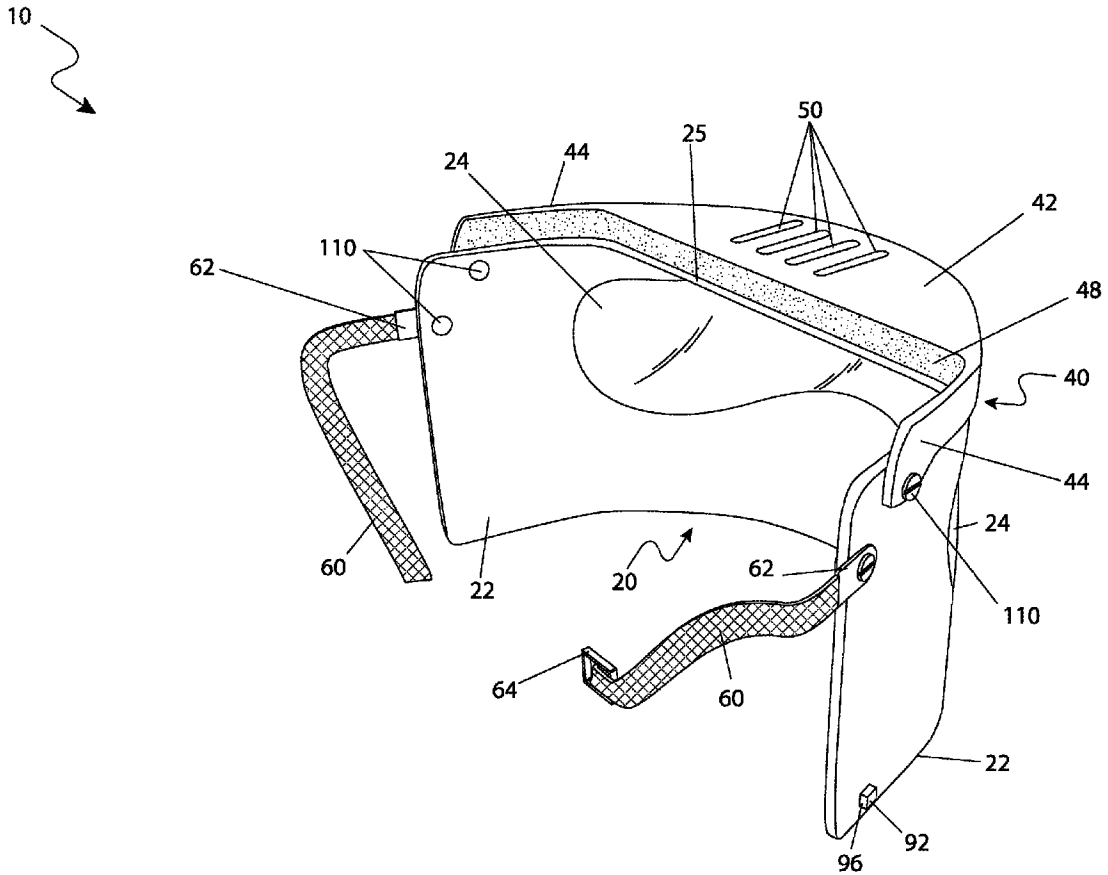
FIG. 2 is a rear perspective view of a sport helmet with ventilating fan 10, according to a preferred embodiment of the present invention.

Referring now to FIGS. 1 and 2, side and rear perspective views of the apparatus 10, according to a preferred embodiment of the present invention, are disclosed. The apparatus 10 comprises a helmet assembly 20 which is similar thereto commercially available paintball helmets which completely encompass the face of a user, thereby providing protection against the impact of paintballs. The helmet assembly 20 comprises a unitary molded "U"-shaped form further comprising portions including a helmet shell 22, an integral face shield 24, and, a horizontal rearwardly extending top vent panel 25 which further comprises a plurality of parallel oval-shaped ventilation apertures 26. The helmet assembly 20 secures to a rear portion of a user's head using a two (2) piece elastic and adjustable head strap assembly 60 which wraps around the user's head and utilizes a length adjusting fitting 64 such as a tri-glide or equivalent molded plastic device. The head strap assembly 60 comprises a strong strapping material such as nylon, canvas fabric, flexible extruded plastic, or the like. The head strap assembly 60 is affixed to a pair of second attachment aperture portions 30 of said helmet shell 22 via a pair of integral plastic or metal head strap eyelets 62 located at end portions of said head strap assembly 60 being affixed thereto using common joining processes such as welding, crimping, or the like. Said head strap eyelets 62 and second attachment apertures 30 are joined by horizontally inserting and threadingly engaging a pair of post fasteners 110, thereby providing a pivoting connection of the head strap assembly 60 with regards to the helmet assembly 20.

The face shield portion 24 of the helmet assembly 20 comprises a transparent and distortion-free arcuate plastic panel providing protection to the user's eyes. The helmet assembly 20 also comprises a removably attachable visor assembly 40 which encloses the fan 82 while providing a normal shading means (see FIG. 3*a*). The helmet assembly 20, face shield 24, and visor assembly 40 are to be fabricated using resilient shock-resistant plastic compounds common in the industry and may be introduced having various colors and patterns.

Figures 3A, 3B:
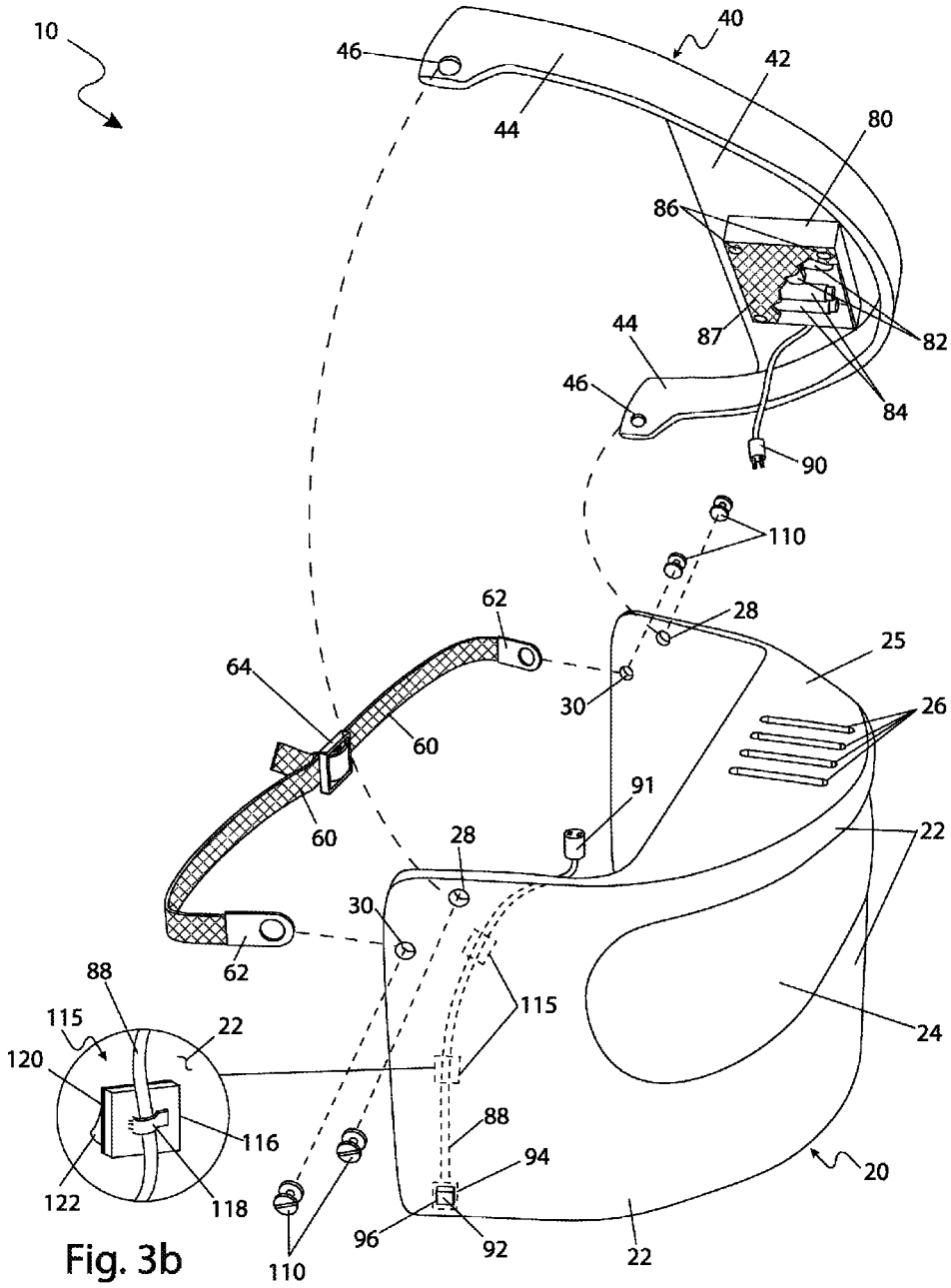
FIG. 3*a* is an exploded view of a sport helmet with ventilating fan 10, according to a preferred embodiment of the present invention.
FIG. 3*b* is a close-up view of a clip fastener portion 115 of the sport helmet with ventilating fan 10, according to a preferred embodiment of the present invention.

Referring now to FIG. 3*a*, an exploded view of the apparatus 10, according to a preferred embodiment of the present invention; is disclosed. The helmet assembly 20 further comprises anti-fogging components which are housed within an interior space of the visor assembly 40 and comprise an electrical enclosure 80, a fan 82, at least one (1) battery 84, and interconnecting electrical wiring 88.

The electrical enclosure 80 provides a protective molded plastic housing containing the fan 82 and batteries 84. Said electrical enclosure 80 comprises a rectangular enclosure further comprising a filtering screen cover 87 along a bottom surface. Said electrical enclosure 80 is to be located therewithin a forwardly extending visor brim portion 42 of the visor assembly 40 subjacent to a plurality of intake apertures 50 on an upper surface of the visor brim portion 42 and affixed discreetly to a bottom surface of said visor brim portion 42 using a plurality of enclosure fastening means 86 such as screws, snapping post-and-socket fasteners, or the like, at corner locations, thereby allowing a user ease-of-access when replacing said batteries 84. Said electrical enclosure 80 and enclosed fan 82 provide thermal comfort and improved visibility to the user while wearing the apparatus 10 while participating in a paintball sport or similar activity. The batteries 84 are to be mounted electrically within the electrical enclosure 80 and preferably comprise disposable or rechargeable DC cells being one and one-half (1½) or nine (9) volts.

The fan 82 comprises a horizontally-mounted unit which inducts air through the intake apertures 50; directs an air flow 100 downwardly through the aforementioned screen cover 87; through the ventilation apertures 26; into the helmet assembly 20; and, subsequently motioned across the face shield portion 24, thereby providing a defogging means to said face shield 24 and a cooling means thereto the user. The fan 82 is centrally located and mounted thereto a bottom surface of the visor brim portion 42 of the visor assembly 40. The fan 82 is envisioned to comprise a standard miniature "muffin" style DC electrical fan 82 having a rectangular housing and being approximately one-and-a-half (1½) to two (2) inches on each side.

The electrical wiring 88 comprises an integral male connector 90 and a female connector 91 which provide a detachable means between the electrical enclosure 80 and an ON/OFF switch 92 located along a side surface of the helmet shell 22 for ease of connecting and disconnecting the anti-fogging components from the helmet assembly portion 20 of the apparatus 10. The connectors 90, 91 comprise common miniature two (2) prong insulated components. The electrical wiring 88 is removably attached thereto an inter surface of the helmet assembly 20 therewith a plurality of common clip fasteners 115 (see FIG. 3*b*).

The ON/OFF switch 92 is envisioned to comprise a common "push-on, push-off" manual pushbutton device providing user-initiated power to the fan 82. Said ON/OFF switch 92 is to be conveniently located along a side surface of the helmet shell 22. Said switch 92 comprises a panel-mount device being mounted thereto an inner surface of the helmet shell 22 using a switch fastener 94 preferably comprising a hook-and-loop fastening means for easy removal. A button portion of the switch 92 protrudes through a switch aperture 96 located along a side surface of said helmet shell 22, thereby allowing a user to easily activate the switch 92 to supply electrical power to the fan 82 as needed. The switch 92 is depicted here as a common pushbutton-type device; however, other switch types may be also provided such as toggle, single pole-single throw (SPST), a multi-way switch, a rocker switch, and the like, providing equal benefit, and as such should not be interpreted as a limiting factor of the apparatus 10.

The visor assembly 40 is removably attached to the helmet shell 22 via a pair of visor apertures 46 located along visor temple portions 44 of said visor assembly 40, and corresponding first attachment apertures 28 being located at opposing side portions of the helmet shell 22. Said aligned apertures 46, 28 are joined by horizontally inserting a pair of post fasteners 110, thereby providing a pivoting connection means allowing the visor assembly 40 to be pivoted upwardly to access the electrical enclosure 80 as needed (see FIG. 4).

Said visor assembly 40 additionally comprises an arcuate foam rubber pad 48 across a rear curved edge of the visor brim portion 42 being affixed using common adhesives. Said pad 42 extends downwardly to provide a parallel seal against a top surface of the subjacent vent panel 25. Said pad 48 also provides a soft padded surface to protect a users head if contacted during use.

Referring now to FIG. 3*b*, a close-up view of a clip fastener portion 115 of the apparatus 10, according to a preferred embodiment of the present invention, is disclosed. The clip fasteners 115 comprises a common molded plastic device providing removable attachment of the electrical wiring 88 being routed along an inner surface of the helmet shell 22. Said clip fasteners 115 comprise a common tacky adhesive layer 120 along a rear surface being protected using a peel-off wax paper backing 122. Each clip fastener 115 further comprises a base 116 and an integral flexible hook feature 118 providing a protruding arcuate profile designed to capture the electrical wire 88 securely between said hook 118 and said base 116. It is understood by those skilled in the art that other wire fastening devices such as hook-and-loop fasteners may also be used with equal benefit without deviating from the concept and as such should not be interpreted as a limiting factor of the apparatus 10.

Referring now to FIG. 4, a close-up view of a post fastener portion 110 of the apparatus 10, according to a preferred embodiment of the present invention, is disclosed. The post fastener 110 provides removable attachment of the visor assembly 40 and head strap assembly 60 to the side portions of the helmet shell 22. Said post fasteners 110 comprise common two-piece plastic or metal threaded fasteners commonly used for binding books, manuals, and the like. Each post fastener 110 comprises a female threaded post 111 and a male threaded screw 112 portion being threadingly engaged so as to result in a specific gap therebetween being slightly greater than a combined thickness of the joined portions 20, 40, 60, thereby allowing free rotary motioning of said visor assembly 40 and head strap assembly 60 with respect to the helmet shell 22.

Referring now to FIG. 5, an electrical block diagram of the apparatus 10, according to a preferred embodiment of the present invention, is disclosed. The apparatus 10 comprises a simple DC circuit being powered by the batteries 84 housed within the electrical enclosure 80. The batteries 84 are interconnected thereto a "push-on, push-off" type switch 92 and subsequently to the fan 82 using common electrical wiring 88. When initially depressed, the switch 92 closes the circuit, thereby directing power to the fan 82 which in turn circulates ambient air 100 into the helmet assembly 20 and across the face shield portion 24. Pressing the switch 92 a second time opens the circuit, thereby shutting off the fan 82 and stopping the flow of air 100.

Referring now to FIG. 6, a side perspective view of an alternate retrofit embodiment 150 of the apparatus 10, is disclosed. The electrical enclosure 80, fan 82, switch 92, and electrical wiring 88, may also be provided as an add-on aftermarket kit for installation on existing helmets 160 by a final user. The existing helmet 160 is envisioned to comprise basic portions such as an existing visor 162, an existing face shield 164, an existing head strap 180, and an existing strap fastener 185. Various modifications to said existing helmet 160 and/or existing visor portion 162 may be required to properly install and facilitate said alternate retrofit embodiment 150. Said alternate retrofit embodiment 150 may be affixed to the interior or exterior surfaces of said existing helmet 160 and secured using the clip fasteners 115, the switch fastener 94, as well as various other fastening means as required.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 through 3.

The method of utilizing the apparatus 10 may be achieved by performing the following steps: procuring the apparatus 10 having a desired size and color; removing the electrical enclosure 80 from the visor assembly 40 by removing the enclosure fastening means 86; installing a fresh or recently charged set of disposable or rechargeable batteries 84 into the electrical enclosure 80; replacing the electrical enclosure 80 to the visor assembly 40 using the enclosure fastening means 86; connecting the visor assembly 40 to the helmet assembly 20 by inserting post fasteners 110 through the first attachment apertures 28 and the visor apertures 46; threadingly engaging post 111 and screw 112 portions of the post fasteners 110; connecting the male 90 and female 91 portions of the wiring 88; pivoting the visor assembly 40 downwardly until the pad portion 48 contacts the subjacent vent panel portion 25 of the helmet assembly 20; mounting the head strap assembly 60 to the helmet shell 22 by inserting the post fasteners 110 through the second attachment apertures and the head strap eyelets 62; threadingly engaging post 111 and screw 112 portions of the post fasteners 110; positioning the apparatus 10 on the user's head in a normal manner; adjusting a length of the head strap assembly 60 using the length adjusting fitting 64 as needed, to obtain a desired comfortable fit; depressing the switch 92 to provide power to the fan 82, thereby circulating ambient air 100 through the visor apertures 46, the fan 82, the screen cover 87, the ventilation apertures 26, and finally across the face shield portion 24 of the helmet assembly 20 to remove or prevent condensation and fogging of said face shield 24; participating in a paintball sport or other similar activity as desired; depressing the switch 92 a second time to turn off the fan 82 upon completion of said activity; removing the helmet assembly 20 from the users head; and, storing the apparatus 10 until once again needed.

The method of utilizing the alternate retrofit embodiment 150 of the apparatus 10 may be achieved by performing the following steps: acquiring the alternate retrofit embodiment 150 comprising the electrical enclosure 80, fan 82, switch 92, electrical wiring 88, and provided fasteners; retrofitting the apparatus 10 into an existing helmet 160 by making any required mechanical modifications to the helmet 160 and/or visor 162 portions necessary to facilitate the alternate retrofit embodiment 150; mounting the electrical enclosure 80 to the existing helmet 160 or visor 162; mounting the switch 92 to the existing helmet 160 using the switch fastener 94; routing the wiring 88 along internal or external surfaces of the existing helmet 160 as desired; securing said electrical wiring 88 to the surface of the existing helmet 160 by affixing a plurality of clip fasteners 115 by removing the paper backing 122 from the adhesive layer 120; pressing and securing the clip fastener 115 against said surface of the existing helmet 160; inserting the wiring 88 into the hook portions 118 of said clip fasteners 115; joining the male 90 and female 91 connector portions of the wiring 88; positioning the existing helmet 160 on the user's head in a normal manner; operating the air circulation function of the alternate retrofit embodiment 150 as described above.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A helmet, comprising:

a helmet assembly comprising a removable visor assembly, comprising:

a helmet shell and interior;

a face shield integral with said helmet shell;

a vent panel superjacent of said face shield and horizontally extending toward said interior;

a visor assembly pivotally attached to said helmet shell superjacent to said vent panel; and, a helmet adjustment means pivotally attached to said helmet shell; and, a ventilating fan assembly attached within said helmet assembly in electrical communication with a power supply;

wherein said vent panel is in fluid communication with said ventilating fan assembly to direct a forced air flow from said ventilating fan assembly to said interior;

wherein said forced air flow provides an anti-fogging and a cooling means to said interior of said helmet assembly;

wherein a fan of said ventilation fan assembly is disposed within said visor assembly; and wherein said helmet adjustment means adjustably positions said helmet assembly onto a head of a user to provide a comfortable fit thereto.

2. The helmet of claim 1, wherein said helmet assembly further comprises a paintball helmet, wherein said helmet shell further comprises a unitary molded "U"-shaped form having a front face and a rear face; and, a plurality of post fasteners for pivotally attaching said visor assembly to said helmet shell and said helmet adjustment means to said helmet shell.

3. The helmet of claim 2, wherein said face shield further comprises a transparent and distortion-free arcuate plastic panel corresponding to a contour of said helmet shell.

4. The helmet of claim 2, wherein said vent panel further comprises a plurality of ventilation apertures subjacent to said fan within said visor assembly for directing said forced air flow into said interior;

wherein said ventilation apertures directs said forced air flow within said interior and against an interior surface of said face shield.

5. The helmet of claim 2, wherein said visor assembly further comprises:

a visor brim portion;

a plurality of intake apertures on an upper surface of said visor brim portion;

a pair of visor temple portions rearwardly extending from opposing ends of said visor brim portion; and, a pair of visor apertures on opposing ends of said pair of visor temple portions pivotally attached to a pair of first attachment apertures on opposing upper rear portions of said front face of said helmet shell with a pair of said post fasteners;

wherein said fan is disposed with said visor brim portion subjacent to said plurality of intake apertures.

6. The helmet of claim 5, wherein said visor assembly further comprises an arcuate foam rubber pad adhesively bonded across a rear curved edge of said visor brim portion and extending downwardly to provide a parallel seal against a top surface of said vent panel;

wherein said rubber pad further comprises a soft padded surface to protect said head of said user.

7. The helmet of claim 2, wherein said helmet adjustment means further comprises:

a two-piece elastic and adjustable head strap assembly with a length adjusting fitting; and, a pair of head strap eyelets on opposing ends of said head strap assembly pivotally attached to a pair of second attachment apertures on opposing upper rear portions of said front face of said helmet shell with a pair of said post fasteners;

wherein said pair of second attachment apertures are adjacent to said pair of first attachment apertures.

8. The helmet of claim 1, wherein said each of said post fasteners comprise a two-piece fastening means further comprising:

a female threaded post portion; and, a male threaded screw portion correspondingly mating with said female threaded post portion so as to result in a specific gap therebetween.

9. The helmet of claim 1, wherein said ventilating fan assembly further comprises:

an electrical enclosure affixed within said visor assembly, wherein said power supply is provided therein;

said fan mounted within said electrical enclosure, directing said forced air flow downward;

a filtering screen cover along a bottom surface of said electrical enclosure subjacent to said fan; and, a control means in electrical communication with said power supply and said fan;

wherein said screen cover filters said forced air flow prior to entry within said interior.

10. The helmet of claim 9, wherein said power supply further comprises a plurality of batteries.

11. The helmet of claim 9, wherein said fan further comprises a "muffin"-style DC electrical fan approximately one-and-a-half (1½) to two (2) inches on each side.

12. The helmet of claim 9, wherein said control means further comprises:

a power switch mounted to said rear face of said helmet shell with a fastening means and protruding through a switch aperture such that an actuator of said power switch extends past said front face of said helmet shell;

a first electrical wire in electrical communication with said fan and having a male connector;

a second electrical wire in electrical communication with said power switch, having a female connector correspondingly mating with said male connector; and, a plurality of clip fasteners for removably affixing said first electrical wire and said second electrical wire to said rear face of said helmet shell;

wherein said power switch selectively provides power from said power supply to said fan.

13. The helmet of claim 12, wherein said plurality of clip fasteners each further comprise:

a base;

an integral flexible hook feature outwardly extending from a first side of said base, providing a protruding arcuate profile;

a tacky adhesive layer along a second side of said base; and, a peel-off paper backing removably placed on said adhesive layer;

wherein said adhesive layer removably affixes said clip fastener to said helmet shell; and, wherein said first electrical wire or said second electrical wire is removably captured within said flexible hook feature.

* * * * *